US009909585B2

(12) United States Patent
Mauser

(10) Patent No.: US 9,909,585 B2
(45) Date of Patent: Mar. 6, 2018

(54) VARIABLE DISPLACEMENT PUMP

(71) Applicant: Magna Powertrain Bad Homburg GmbH, Bad Homburg (DE)

(72) Inventor: Thilo Mauser, Bad Vilbel (DE)

(73) Assignee: MAGNA POWERTRAIN BAD HOMBURG GMBH, Bad Homburg (DE)

( * ) Notice: Subject to any disclaimer, the term of this patent is extended or adjusted under 35 U.S.C. 154(b) by 260 days.

(21) Appl. No.: 14/425,250

(22) PCT Filed: Sep. 3, 2013

(86) PCT No.: PCT/DE2013/100313

§ 371 (c)(1),
(2) Date: Mar. 2, 2015

(87) PCT Pub. No.: WO2014/053119

PCT Pub. Date: Apr. 10, 2014

(65) Prior Publication Data

US 2015/0240809 A1 Aug. 27, 2015

(30) Foreign Application Priority Data

Oct. 5, 2012 (DE) ..... 10 2012 109 495

(51) Int. Cl.

| | |
|---|---|
| ***F01C 20/22*** | (2006.01) |
| ***F03C 2/30*** | (2006.01) |
| ***F04C 14/18*** | (2006.01) |
| ***F04C 28/18*** | (2006.01) |
| ***F04C 2/356*** | (2006.01) |
| ***F01C 21/10*** | (2006.01) |
| ***F04C 2/344*** | (2006.01) |
| ***F04C 14/22*** | (2006.01) |

(Continued)

(52) U.S. Cl.

CPC ..... *F04C 2/356* (2013.01); *F01C 21/108* (2013.01); *F04C 2/3442* (2013.01); *F04C 13/002* (2013.01); *F04C 14/18* (2013.01); *F04C 14/226* (2013.01); *F04C 15/008* (2013.01); *F04C 2/3447* (2013.01); *F04C 2/44* (2013.01)

(58) Field of Classification Search

CPC ..... F04C 14/226
USPC ..... 418/24–28, 30; 417/220
See application file for complete search history.

(56) References Cited

U.S. PATENT DOCUMENTS 5,518,380 A * 5/1996 Fujii ..... F04C 14/226 418/26
8,202,061 B2 * 6/2012 Shulver ..... F01M 1/16 417/212

(Continued)

FOREIGN PATENT DOCUMENTS

| | | | |
|---|---|---|---|
| AT | 507803 | A4 | 8/2010 |
| DE | 102008037684 | A1 | 2/2009 |
| DE | 102010010799 | A1 | 9/2010 |

OTHER PUBLICATIONS

International Search Report dated Nov. 26, 2013.

*Primary Examiner* — Mark Laurenzi
*Assistant Examiner* — Deming Wan
(74) *Attorney, Agent, or Firm* — Dickinson Wright PLLC

(57) ABSTRACT

Disclosed is a pump having adjustable conveying volumes, in particular a vane, roller-cell or pendulum-slide pump, comprising a rotation assembly, a lifting ring and a rotationally driven rotor with extendable and retractable vanes, rollers or pendulum sliders that are guided in slots.

19 Claims, 6 Drawing Sheets

Figure 1:
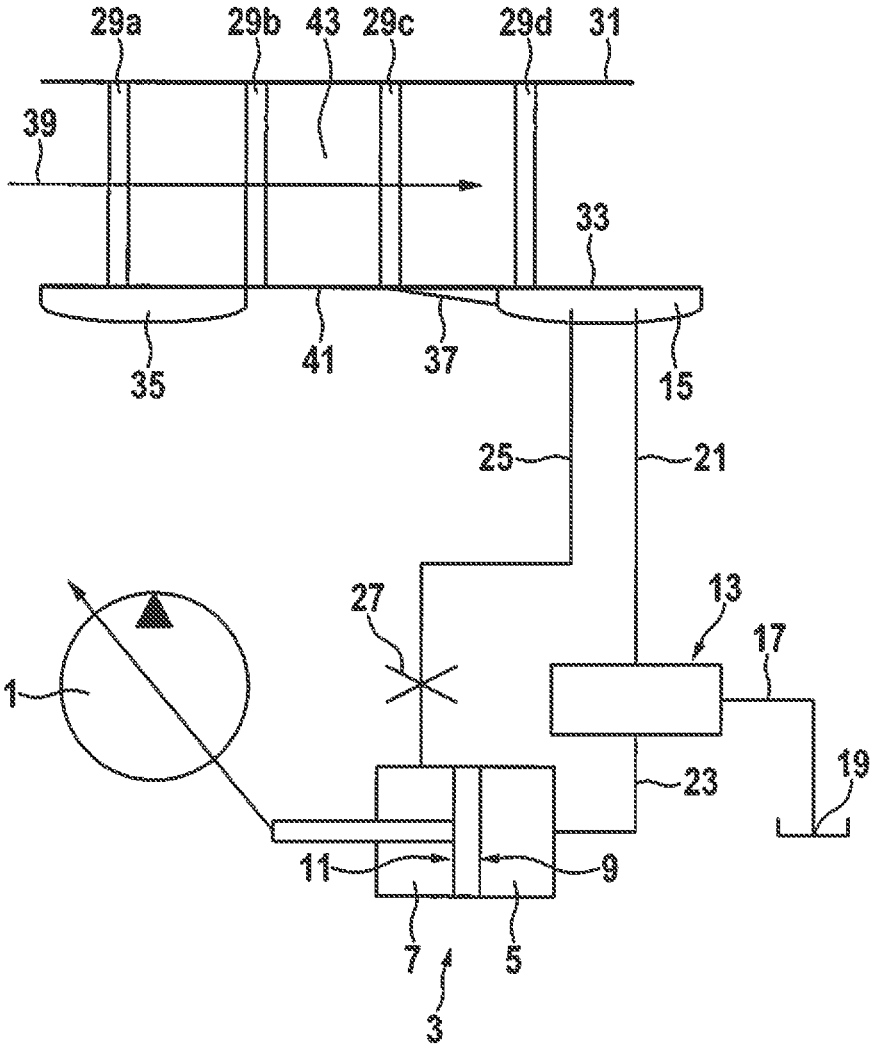

(51) Int. Cl.

| | |
|---|---|
| ***F04C 13/00*** | (2006.01) |
| ***F04C 15/00*** | (2006.01) |
| *F04C 2/44* | (2006.01) |

(56) References Cited

U.S. PATENT DOCUMENTS

| | | | | |
|---|---|---|---|---|
| 2002/0172610 | A1* | 11/2002 | Jeronymo ..... | F04C 14/226<br>418/30 |
| 2007/0280842 | A1 | 12/2007 | Ueki et al. | |
| 2009/0047141 | A1 | 2/2009 | Yamamuro et al. | |

* cited by examiner

VARIABLE DISPLACEMENT PUMP

CROSS-REFERENCE TO RELATED APPLICATIONS

This application is a National Stage of International Application No. PCT/DE2013/100313 filed Sep. 3, 2013 which claims the benefit of and priority to German Application No. 10 2012 109 495.0 filed Oct. 5, 2012. The entire disclosure of each of the above applications is incorporated herein by reference.

FIELD

The invention relates to a variable displacement pump, in particular a vane-cell, roller-cell or pendulum-slider pump, comprising a rotation assembly, comprising a stroke ring and a rotationally driven rotor having retractable and extensible vanes, roller or pendulum sliders which are guided in slots, wherein the vane, roller or pendulum sliders form together with the rotor and the stroke ring variable delivery cells, wherein in a centric position of the stroke ring relative to the rotor the stroke volume during rotation does not vary, while in the case of an eccentric position of the stroke ring relative to the rotor it does vary, so that the cell volume increases in the suction region of the pump and decreases in the pressure region of the pump. Pendulum-slider pumps possess a so-called displacement housing as the stroke ring.

BACKGROUND

Pumps of this type are known. They have an adjusting device for adjusting the stroke ring, wherein the adjusting device has at least one pressure-action surface for generating an adjusting force upon the stroke ring, which adjusting force, regulated for instance by a valve, is generated by an adjusting pressure which lies between the high pressure and the suction pressure of the pump (so-called feed control).

Other known pumps have an adjusting device comprising a pressure-action surface for generating an adjusting force upon the stroke ring and a further, additional pressure-action surface for generating a compensation force. The adjusting force (generally jointly with an additional spring for generating a spring force), by virtue of a pressure controlled by the valve, will here adjust the stroke ring in the direction of high eccentricity (full stroke), while the pressure-action surface for the compensation force as the counter-force (in the prior art) is directly connected to the pressure region of the pump (so-called discharge control).

Known pumps of this type have problems. Thus, in the region of the pump between the suction region and the high-pressure region is arranged a separation region of at least one cell width, which is intended to prevent a short-circuit between the pressure region and the suction region. The cells rushing through this separation region are thus transported from the suction region with suction pressure into the pressure region and are there charged by the high pressure which prevails there. During this passage through the separation region, alternating pressure fields and pressure fluctuations, which impact as internal forces on the stroke ring pressure-clamped by the external and internal pressures, are thus constantly produced by the so-called reversal of the rapidly passing cells in the peripheral direction.

Furthermore, in the case of different eccentric positions of the stroke ring, different angular positions of the separation region relative to the stroke ring also arise.

In the separation region, moreover, at full stroke, as a result of a geometrically based precompression in the closed-off cell region, a pressure which can be higher than the system pressure, momentarily set by a consuming unit, in the pressure region of the consuming unit, for instance a transmission, can optionally prevail. At zero delivery, no precompression prevails in the separation region.

In addition, the high pressure is dependent on the momentary operating states of the consuming unit (for example, the transmission) and is thus subject to large fluctuations.

The adjusting force upon the stroke ring derives from an equilibrium of the forces which are generated by the pressure-action surface of the control chamber, by the pressure-action surface of the compensation chamber, by the spring and by the force vectors defined by the position of these chambers. It is opposed by the inner forces in the stroke ring which result from the cells loaded with system pressure or suction pressure, which cells constantly change, as well as by friction forces.

Since the resultant force vector of the system-based forces within the pump thus varies in size and direction with different operating states, the control pressure, i.e. pressure in the control chamber, must be changed correspondingly in order to achieve a force equilibrium. This leads in the prior art to persistent control deviations.

The pressure distribution within the movably mounted component, i.e. the stroke ring, thus has a substantial influence on the changes in the pump-internal system-based forces. In particular at the places at which passing cells change from suction pressure to system pressure or vice versa, fluctuating forces, which exert very different loads in dependence on the operating point, are active.

SUMMARY

The object of the present invention is to keep the control pressure for the different operating points of the consuming unit broadly constant and/or to compensate the variations or disturbances resulting from the reversing operations.

The object of the present invention is achieved by a variable displacement pump, in particular a vane-cell, roller-cell or pendulum-slider pump comprising: a rotation assembly including a stroke ring and a rotationally driven rotor having retractable and extensible vanes, rollers or pendulum sliders guided in slots, wherein the vanes, rollers or pendulum sliders form together with the rotor and the stroke ring variable delivery cells, wherein in a centric position of the stroke ring relative to the rotor the stroke volume during rotation does not vary, while in the case of an eccentric position of the stroke ring relative to the rotor it does vary, wherein the cell volume increases in the suction region of the pump and decreases in the pressure region of the pump, wherein a separation region of at least one cell width is arranged between the suction region of the pump and the pressure region of the pump in order to avoid a short-circuit between the two regions when the cells are switched to and fro between the suction region and the pressure region; side plates or housing side walls which axially seal the rotation assembly, wherein the side plates or housing side walls have on at least one side a suction opening (a so-called suction kidney) in the suction region and a pressure-side opening (a so-called pressure kidney) in the pressure region, wherein the pressure kidney optionally has in the direction of the separation region optionally a peripherally extending (so-called) damping notch; an adjusting device for adjusting the stroke ring, wherein the adjusting device has at least a first pressure-action surface of a control chamber for generating an adjusting force upon the stroke ring, and an additional, second pressure-action surface of a compensation chamber which generates a counterforce or compensation force upon the stroke ring; and a regulating/control device, for instance a valve, which can vary the pressure upon the pressure-action surface of the control chamber between high pressure and suction pressure of the pump, and optionally having a spring, which in the pressureless state of the pump shifts the stroke ring into the full eccentric position, i.e. full stroke of the pump during start-up; wherein the pump is characterized in that the additional, second pressure-action surface of the compensation chamber is connected to at least one connection to that region within the pump which extends from the start of the separation region of the pump, i.e. from the end of the suction region, to the end of the damping notch, i.e. to the start of the pressure region or of the pressure kidney, in the peripheral direction within the rotation assembly, i.e. via the reversal region of the pump between the suction region and the pressure region and via the damping notch.

The achievement of the object of the present invention thus consists in directing the constantly changing pressure of the reversing, moving cells onto a hydraulic pressure-action surface, here in the compensation chamber, which acts as an actuator on the adjusting ring. The actuator can now be arranged such that fluctuations in the pressures of the passing cells are compensated. A thus designed system hence keeps the adjusting forces or adjusting torques resulting from internal forces of the stroke ring and from external actuator forces broadly constant. All influencing variables which influence the reversal behavior of the cells are substantially balanced out.

The object of the present invention is further achieved by virtue of the fact that the connection of the separation region to the additional, second pressure-action surface is disposed within the reversal region in one of the side plates or housing side faces.

Furthermore, there is preference for a pump in accordance with the present invention in which the connection of the separation region to the additional, second pressure-action surface is disposed in the adjustable stroke ring. This has the following advantages that the connection in the stroke ring to the reversal region additionally alters, in relation to the connection in the side plates/in the housing through the adjustment of the stroke ring, the angular position in the peripheral direction within the through-rushing cells in the separation region, whereby an additional influence by and on different working points of the control system is enabled, for example, by angularly shifted detection of the reversal points.

The object of the present invention is also achieved by virtue of the fact that the additional, second pressure-action surface of the compensation chamber is equipped with an additional, second connection into the pressure region of the pump, for instance into the pressure kidney. This has the advantage that, if there are two lines to the compensation chamber, one to the reversal region and one to the pressure region, and there are different pressures in these regions, which pressures are generated or set on the one hand on a practically "quasi-fixed" basis by changes in stroke geometry, and on the other hand on a practically "rotation-speed-dynamic" basis by the constant reversal during the rotation, a compensating flow in the compensation chamber ensures lesser pressure fluctuations in the compensation chamber. Moreover, via the compensation chamber, a pressure compensation takes place in the reversing cell with the pressure region parallel to the notch, and thus an additional acoustic improvement occurs.

There is also preference for a pump according to the present invention in which the regulating/control valve is disposed in a (third) connection between the pressure region of the pump and the pressure-action surface of the control chamber. Preferably, the regulating/control valve is adjustable by one or more electromagnets and/or by an external control pressure and/or by an internal control pressure and/or by an electric motor. This has the advantage that for the control circuit of the pump displacement, as well as of the total system (for example the transmission), different control variables can individually or in combination actuate the control valve accordingly.

Another preferred pump constructed in accordance with the present invention is characterized in that the pressure-action surface of the compensation chamber upon the stroke ring, and optionally the pressure-action surface of the control chamber upon the stroke ring, form jointly with the stroke ring, with the pump housing, and optionally with the side plates and with seals forming demarcations for the pressure chambers, the compensation chamber and the control chamber. This has the advantage that, in practice, the stroke ring itself is already used as an adjusting cylinder.

Preference is also given of the present invention to a pump in which the compensation chamber and/or the control chamber are alternatively formed by two adjusting cylinders which act substantially in opposite directions on the stroke ring. This can have the advantage, that the pressure-action surfaces of the adjusting cylinders do not shift in terms of their force vector positions and, moreover, adjusting cylinders can be more easily sealed by annular seals.

In addition, there is preference for a pump in accordance with the present invention in which the stroke ring is arranged pivotably about a bearing bolt or is arranged radially displaceably in a guide. As a result, the bearing bolt or the guide can advantageously be used as additional sealing points for the demarcation of the different pressure chambers.

Another preferred pump of the present invention is characterized in that hydraulic resistors, for instance damping orifices, are arranged in the connections from the compensation chamber to the reversal region and/or to the pressure region and optionally in the connection from the control chamber via the valve connection to the pressure region. This has the advantage that, depending on where the greatest pressure fluctuations and disturbances resulting from the operation of the pump or of the total system (for example the transmission) arise, appropriate stabilizing damping effects can be obtained and a different coordination of the damping orifices, according to place of use and external interference, is possible.

DRAWINGS

Figure 2:
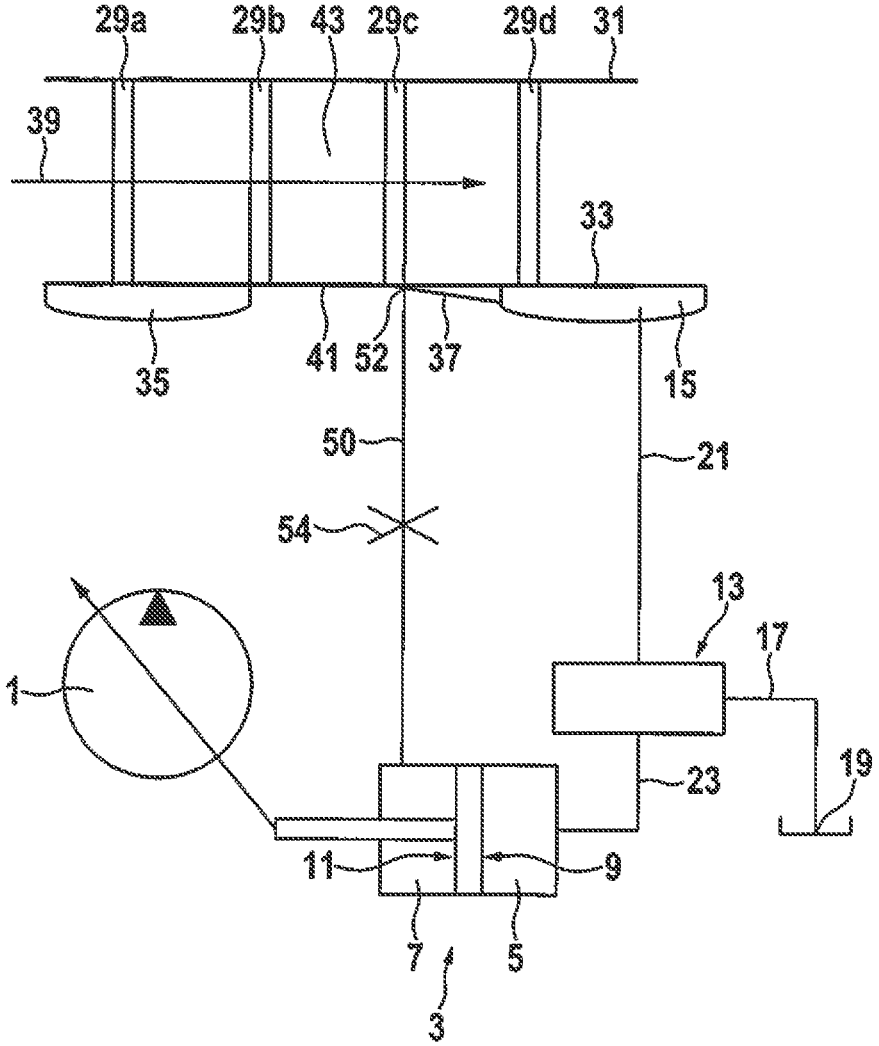
Figure 3:
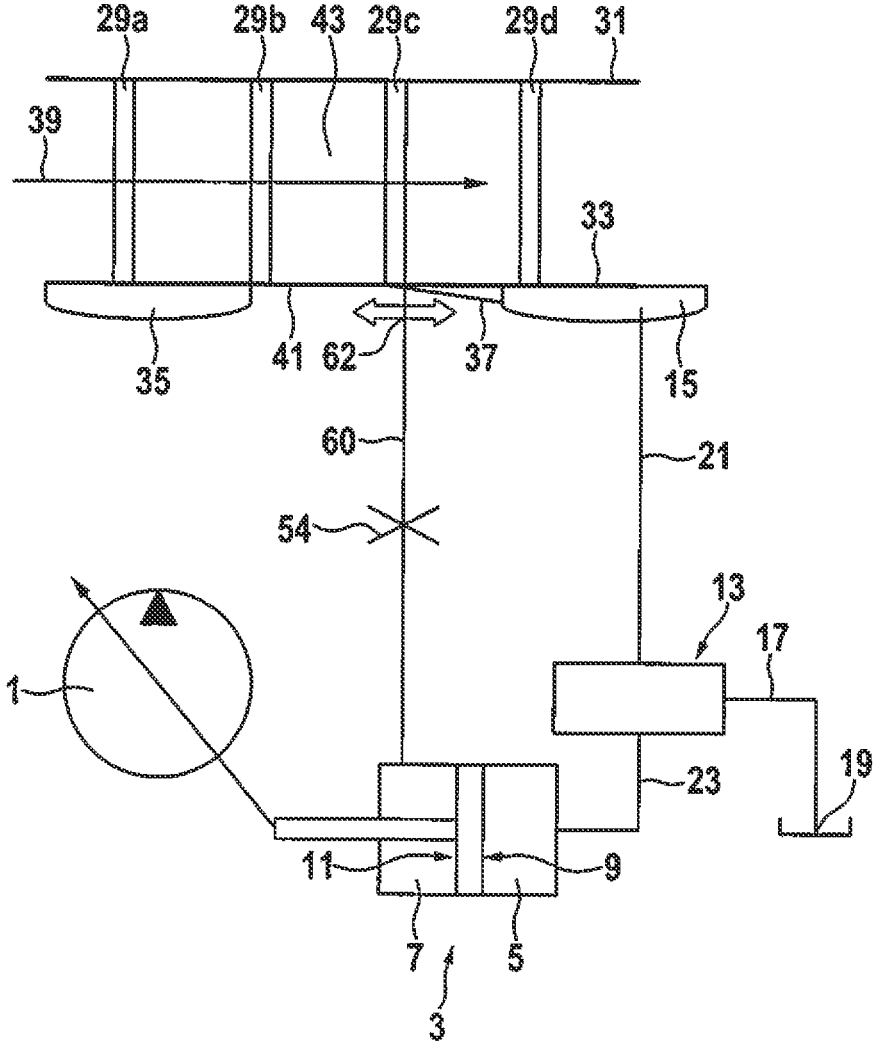
Figure 4:
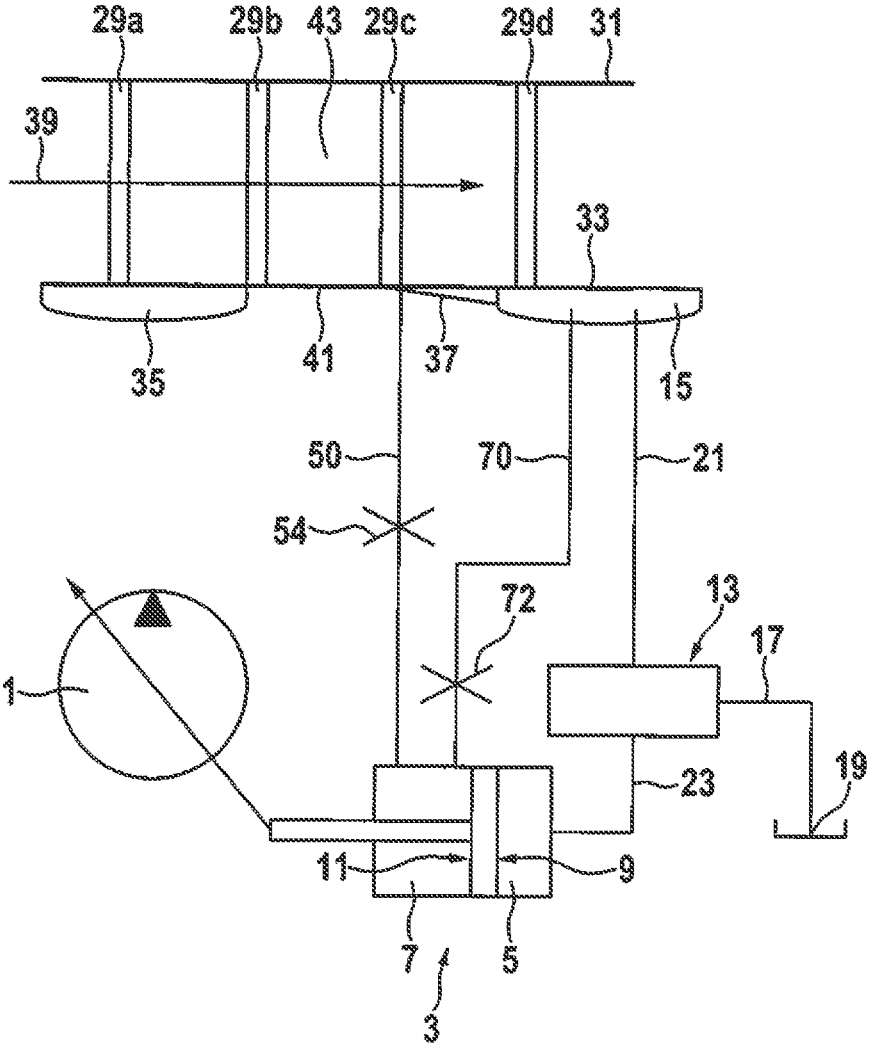
Figure 5:
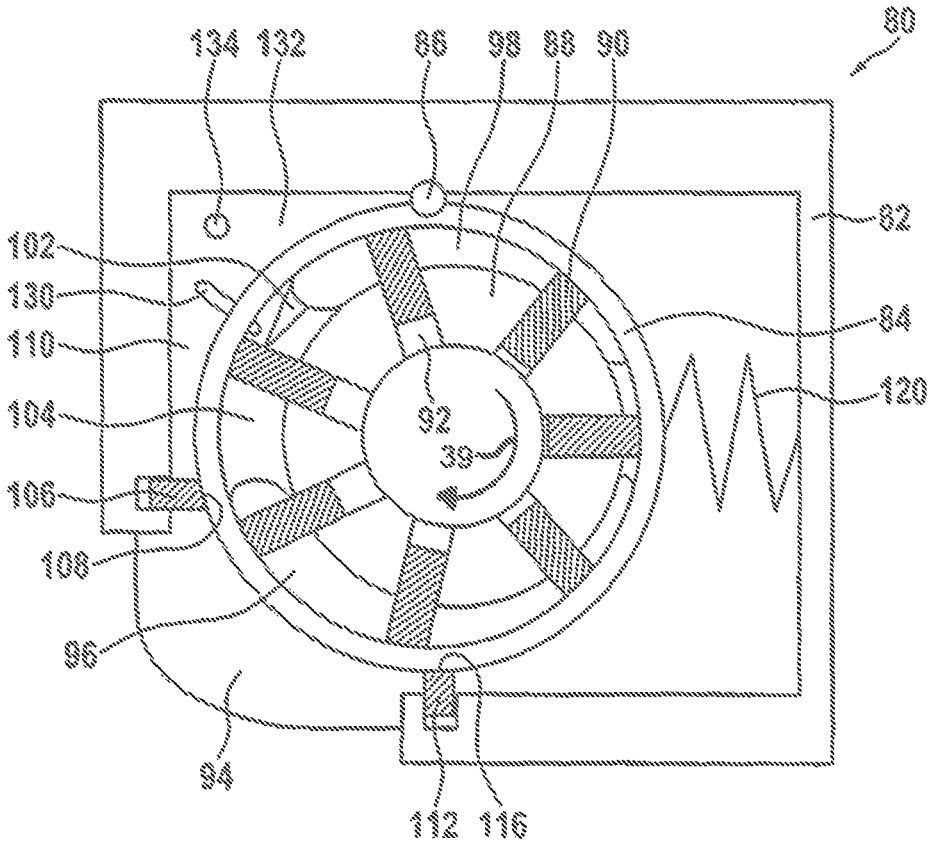
Figure 6:
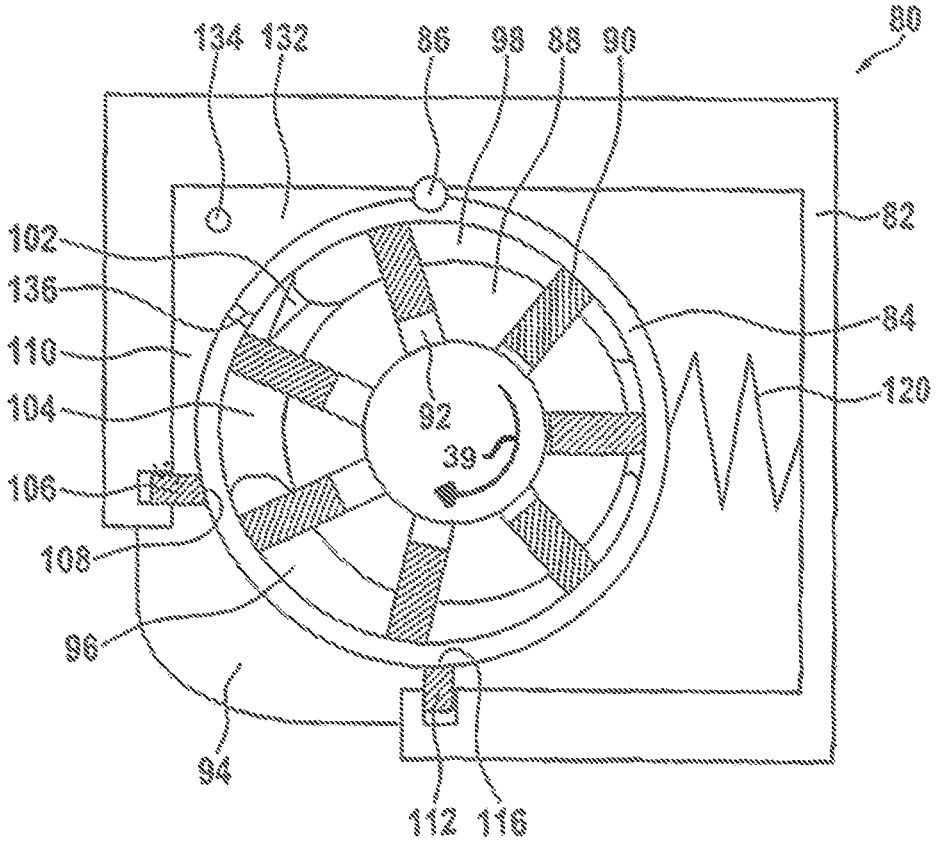

The invention is now described on the basis of the figures, wherein:

FIG. 1 shows schematically a circuitry between variable displacement pump, adjusting device and inner vane-cell regions according to the prior art, FIG. 2 shows a modified circuitry from FIG. 1 according to the present invention with connection of the compensation chamber to the separation region/reversal region, FIG. 3 shows a further modified circuitry with a displaceably arrangeable connection of the compensation chamber to the separation region, FIG. 4 shows a further modified circuitry with an inventive connection of the compensation chamber to the separation region and an additional connection to the pressure region, FIG. 5 shows a top view of an inventive adjustable vane-cell pump, and FIG. 6 shows a further top view of an inventive adjustable vane-cell pump.

DETAILED DESCRIPTION

In FIG. 1, the adjustable vane-cell pump is represented schematically as a variable displacement pump 1. The variable displacement pump 1 is connected to an adjusting device 3, which is represented as a non-equilateral cylinder, having a control chamber 5 and a compensation chamber 7. In the control chamber 5, the control pressure acts on a pressure-action surface 9, and in the compensation chamber 7 the compensation pressure acts on a pressure-action surface 11 which is smaller than the pressure-action surface 9. The pressure in the control chamber 5 is set or regulated by a control device 13 for adjusting the control pressure, such as, for example, a control or regulating valve, between the high pressure or system pressure from the pressure region or the pressure kidney 15 and a pressure in a tank region, which pressure generally corresponds to atmospheric pressure. The tank pressure region, here represented with a connecting line 17, is thus generally connected to a tank 19 or oil sump. The connection between the pressure kidney 15 and the control device 13, the control valve, is established by a connecting line 21, the connection between the control valve and the control pressure chamber 5 by a connecting line 23.

In addition, in the prior art a further connecting line 25 is established between the pressure kidney 15 and the compensation chamber 7, which connecting line is always connected to the system pressure, yet the pump displacement, owing to the smaller pressure-action surface 11, can be produced or kept in equilibrium by a lower pressure upon the larger pressure-action surface 9. Optionally, the connecting line 25 is further provided with a hydraulic damping resistor 27, for instance a damping orifice. The vane cells rushing past the pressure kidney 15, during rotation of the rotor, are represented schematically by vanes 29 *a* to 29 *d*, wherein the vane cells, schematically represented, are axially sealed by the side plates 31 and 33 except for openings in the side plates, here, for instance, the pressure kidney 15 or a suction kidney 35 in the suction region. The pressure kidney 15 has in the peripheral direction counter to the rotational direction, here represented by an arrow 39, a (so-called) damping notch 37. A cell 43, which in the represented position stands exactly in the separation region 41 between the suction kidney 35 and the damping notch 37, has been charged in the suction region, via the suction kidney 35, with the suction pressure or tank pressure, yet still has no connection to the high-pressure region or system pressure region of the pressure kidney 15 or of the damping notch 37 and thus contains only the suction pressure or, optionally, according to the position and geometry of the stroke ring relative to the rotor, a possibly geometric precompression.

The high pressure or system pressure in the pressure region 15 is here defined by the system pressure existing in the connected consuming unit (transmission or steering system or chassis, etc.). It can thus happen that the system pressure or high pressure is correspondingly higher or lower than the pressure prevailing in the separation region 41 of the cell 43, which pressure, after the damping notch 37 has been reached, accordingly performs a pressure-equalizing operation with the high-pressure region. Since these equalizing operations, also as a result of the continuously through-rushing cells, lead in practice to constantly changing pressurizations within the pump, corresponding compressive force disturbance variables are thereby produced in relation to the quasi fixedly set pressures of the adjusting device 3, which is connected only to the high-pressure region via the pressure kidney 15.

In FIG. 2 is therefore represented an inventive circuit, in which the pressures in the separation region 41 (reversal region), or in the cell 43 located there, can impact on the adjusting device 3. Before the start of the damping notch 37, viewed in the rotational direction (arrow 39), a connecting line 50 is connected to the end of the separation region 41, so that, directly after the corresponding vane 29*c* has moved past, the pressure in the cell 43 or in the separation region 41, whether it is now higher or lower than the pressure in the pressure kidney 15, impacts on the pressure-action surface 11 in the compensation chamber 7. For the rest, the same reference numerals apply to the same components or designations as in FIG. 1.

In FIG. 3 is represented a variant of FIG. 2, in which a connecting line 60 to the compensation chamber 7 can be shifted into various positions in the region of the separation region 41, as represented by a double arrow 62, or within the damping notch. Thus, in accordance with the usage conditions which are created by the hydraulic consuming unit and its different working points, an adaptation can be made to the arising pressure differences. A variable connection creation of this type into the separation region 41 of the vane-cell pump can be established, for instance, by a connecting bore within the stroke ring, which latter changes its position over a certain angle during the adjustment and thus also the bore shifts geometrically within the region between the separation region 41 and, where appropriate, the damping notch 37.

In FIG. 4 is represented a further circuitry, which differs from the circuitry from FIG. 2 and also FIG. 3 in that a further additional connection 70 is established from the compensation chamber 7 to the pressure kidney 15, which optionally can also contain a damping orifice 72. This circuit has the additional effect that, in the case of different pressure relationships in the separation region 41 (reversal region) or the cell 43 and the high-pressure region (as already previously described), an equalizing flow between the regions is enabled via the connection 50 through the compensation chamber 7 and via the connecting line 70, so that pressure differences in the compensation chamber itself lead to a more balanced intermediate pressure and can thus lead closer to the desired quasi constant setting point of the variable displacement pump.

In FIG. 5, the top view of a variable displacement pump or its rotation assembly is represented. The variable displacement pump 80 comprises a pump housing 82, in which an adjustable stroke ring 84 is arranged pivotably about a bearing bolt 86. The adjustable stroke ring 84 is here represented in its maximally eccentric position relative to the rotor 88. Within the rotor 88, radially displaceable vanes 90 are disposed within radial slots 92, which, for instance by oil pressure under the vanes or centrifugal forces or by mechanical guides, according to the pump construction, bear with their vane tips sealingly against the stroke ring 84, and thus between the stroke ring 84, the vanes 90 and the rotor 88, as well as corresponding axial side plates or housing side walls 132, form the sealed cells. The sealed cells are connected in the suction region 94 by openings such as, for example, a suction kidney 96, or in the pressure region by openings such as, for example, a pressure kidney 98, to the outer pressure regions of the pump. In addition, a damping notch 102 is disposed on the pressure kidney region 98*a* in the direction of the separation region 104. A sealing device 106, such as, for example, a sealing strip, seals a region between the stroke ring 84 and the housing 82 in such a way that the region 110 thereby forms the so-called compensation chamber between the bearing bolt 86 and the sealing device 106. In accordance with the variable stroke of the stroke ring, the sealing device 106 slides back and forth on the surface 108. In accordance with the stroke motion, a further sealing device 112 slides back and forth on a corresponding surface 116 within the housing 82 and thus forms between the bearing bolt 86 and the sealing device 112 the so-called control chamber, which can be subjected to the control pressure which is to be regulated by a valve. The chamber limitations of the compensation chamber and of the control chamber between the pump housing 82 and the adjustable stroke ring 84 are thus realized in the peripheral direction by the sealing devices 106/112 disposed on the stroke ring 84 and by the bearing pin bolt 86 about which the stroke ring 84 pivots. In addition, the stroke ring 84 is acted on in the full-stroke direction by a spring 120, which is supported in the housing 82. The inventive connection from the separation region 104 into the compensation chamber (region 110) is in this case represented by a depression 130 or notch in the housing side wall 132 (or side plate).

Alternatively, the connection could be established, instead of by the depression 130, also by a bore 136 in FIG. 6 within the stroke ring 84 within the separation region 104 to the compensation chamber (region 110). The additional connection from FIG. 4, the connection 70 to the pressure kidney 15, is here represented by an opening 134, which opens out into the pressure region of the pump outside the rotation assembly. The corresponding working of this particular pump represented in FIG. 5 or FIG. 6 is made clear by the functional descriptions of the previous schematic figures.

The invention is usable in all variable displacement pumps which have hydraulic actuators on stroke-determining, movably mounted components, the system-based, time-variable, pump-internal forces of which can bring about an adjustment of the pump volume.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

| Reference symbol list | |
|---|---|
| 1 | variable displacement pump |
| 3 | adjusting device |
| 5 | control pressure chamber |
| 7 | compensation chamber |
| 9 | pressure-action surface |
| 11 | pressure-action surface |
| 13 | control device |
| 15 | pressure kidney |
| 17 | connecting line |
| 19 | oil sump or tank |
| 21 | connecting line |

-continued

| Reference symbol list | |
|---|---|
| 23 | connecting line |
| 25 | connecting line |
| 27 | damping resistor |
| 29a | vane |
| 29b | vane |
| 29c | vane |
| 29d | vane |
| 31 | side plates |
| 33 | side plates |
| 35 | suction kidney |
| 37 | damping notch |
| 39 | arrow (rotational direction) |
| 41 | separation region |
| 43 | cell |
| 50 | connecting line |
| 54 | damping orifice |
| 60 | connecting line |
| 62 | double arrow |
| 70 | further additional connection |
| 72 | damping orifice |
| 80 | variable displacement pump |
| 82 | pump housing |
| 84 | (adjustable) stroke ring |
| 86 | bearing bolt |
| 88 | rotor |
| 90 | (radially displaceable) vanes |
| 92 | radial slots |
| 94 | suction region |
| 96 | suction kidney |
| 98 | pressure kidney |
| 102 | damping notch |
| 104 | separation region |
| 106 | sealing device |
| 108 | surface |
| 110 | region |
| 112 | sealing device |
| 116 | surface |
| 120 | spring |
| 130 | depression |
| 132 | housing side wall |
| 134 | opening |
| 136 | bore |

The invention claimed is:

1. A variable displacement pump, in particular a vane-cell, roller-cell or pendulum-slider pump, comprising:

a rotation assembly including a housing, a stroke ring and a rotationally driven rotor having retractable and extensible vanes, rollers or pendulum sliders which are guided in slots, wherein the vanes, rollers or pendulum sliders together with the rotor and the stroke ring form variable delivery cells, wherein in a centric position of the stroke ring relative to the rotor the stroke volume during rotation does not vary, wherein in an eccentric position of the stroke ring relative to the rotor the stroke volume varies so that the cell volume increases in a suction region of the pump and decreases in a pressure region of the pump, wherein a separation region of at least one cell width is arranged between the suction region of the pump and the pressure region of the pump in order to avoid a short-circuit between the two regions when the delivery cells are switched to and fro between the suction region and the pressure region;

side plates or housing side walls which axially seal the rotation assembly, wherein the side plates or housing side walls have a suction opening configured as a suction kidney in the suction region and a pressure-side opening configured as a pressure kidney in the pressure region, wherein the pressure kidney has damping notch located in the direction of the separation region;

a first pressure-action surface associated with a control pressure chamber defined between the housing and the stroke ring for generating an adjusting force upon the stroke ring, and a second pressure-action surface associated with a compensation chamber defined between the housing and the stroke ring for generating a counterforce or compensation force upon the stroke ring; and a regulating/control device which can vary the pressure upon one of the first and second pressure-action surfaces between high pressure and suction pressure of the pump, wherein the second pressure-action surface of the compensation chamber defined between the housing and the stroke ring is connected by a connection disposed in at least one of the side plates, the housing side walls, or the stroke ring to a region within the pump which extends from the start of the separation region of the pump to the end of the damping notch in the peripheral direction within the rotation assembly.

2. The pump as claimed in claim 1 wherein the connection is located in the separation region of the pump between the suction region and the pressure region and/or the damping notch.

3. The pump as claimed in claim 1 wherein the connection of the separation region to the second pressure-action surface is disposed within the separation region in one of the side plates or housing side walls.

4. The pump as claimed in claim 1 wherein the connection of the separation region to the second pressure-action surface is disposed in the adjustable stroke ring.

5. The pump as claimed in claim 1 wherein the second pressure-action surface of the compensation chamber is equipped with a second connection into the pressure region of the pump and into the pressure kidney.

6. The pump as claimed in claim 5 wherein the regulating/control device is disposed in a third connection between the pressure region of the pump and the pressure-action surface of the control chamber.

7. The pump as claimed in claim 6 wherein the regulating/control device is a control valve adjusted by one or more electromagnets and/or by an external control pressure and/or by an internal control pressure and/or by an electric motor.

8. The pump as claimed in claim 1 wherein the first pressure-action surface of the compensation chamber upon the stroke ring and the second pressure-action surface of the control chamber upon the stroke ring jointly form with the stroke ring, with the pump housing, with the side plates, and with sealing devices, demarcations for the pressure chambers, the compensation chamber and the control chamber.

9. A variable displacement pump, in particular a vane-cell, roller-cell or pendulum-slider pump, comprising:

a rotation assembly including a housing, a stroke ring and a rotationally driven rotor having retractable and extensible vanes, rollers or pendulum sliders which are guided in slots, wherein the vanes, rollers or pendulum sliders form together with the rotor and the stroke ring variable delivery cells, wherein in a centric position of the stroke ring relative to the rotor the stroke volume during rotation does not vary, while in the case of an eccentric position of the stroke ring relative to the rotor it does vary, so that the cell volume increases in a suction region of the pump and decreases in a pressure region of the pump, wherein a separation region of at least one cell width is arranged between the suction region of the pump and the pressure region of the pump in order to avoid a short-circuit between the two regions when the cells are switched to and fro between the suction and the region pressure region;

side plates or housing side walls which axially seal the rotation assembly, wherein the side plates or housing side walls have on at least one side a suction-side opening in the suction region and a pressure-side opening in the pressure region, wherein the pressure-side opening has in the direction of the separation region a peripherally extending damping notch;

a first pressure-action surface of a control pressure chamber defined between the housing and the stroke ring for generating an adjusting force upon the stroke ring, and a second pressure-action surface of a compensation chamber defined between the housing and the stroke ring which generates a counterforce or compensation force upon the stroke ring;

a regulating/control device, for instance a valve, which can vary the pressure upon one of the first and second pressure-action surfaces between high pressure and suction pressure of the pump;

a spring which in the pressureless state of the pump shifts the stroke ring into the full eccentric position; and wherein the second pressure-action surface of the compensation chamber defined between the housing and the stroke ring is brought into fluid communication with a specified region which starts at the beginning of the separation region and ends at the start of the pressure region via at least one connection disposed between the compensation chamber and the specified region.

10. A variable displacement pump, in particular a vane-cell, roller-cell or pendulum-slider pump, comprising:

a rotation assembly including a housing, a stroke ring and a rotationally driven rotor having retractable and extensible vanes, rollers or pendulum sliders which are guided in slots, wherein the vanes, rollers or pendulum sliders form together with the rotor and the stroke ring variable delivery cells, wherein in a centric position of the stroke ring relative to the rotor the stroke volume during rotation does not vary, while in the case of an eccentric position of the stroke ring relative to the rotor it does vary, so that the cell volume increases in a suction region of the pump and decreases in a pressure region of the pump, wherein a separation region of at least one cell width is arranged between the suction region of the pump and the pressure region of the pump in order to avoid a short-circuit between the two regions when the cells are switched to and fro between the suction and the region pressure region;

side plates or housing side walls which axially seal the rotation assembly, wherein the side plates or housing side walls have on at least one side a suction-side opening (a so-called suction kidney) in the suction region and a pressure-side opening (a so-called pressure kidney) in the pressure region, wherein the pressure kidney has in the direction of the separation region a peripherally extending damping notch;

a first pressure-action surface of a control pressure chamber defined between the housing and the stroke ring for generating an adjusting force upon the stroke ring, and a second pressure-action surface of a compensation chamber defined between the housing and the stroke ring which generates a counterforce or compensation force upon the stroke ring;

a regulating/control device, for instance a valve, which can vary the pressure upon one of the first and second pressure-action surfaces between high pressure and suction pressure of the pump; and a spring which in the pressureless state of the pump shifts the stroke ring into the full eccentric position (full stroke of the pump during start-up);

wherein the second pressure-action surface of the compensation chamber defined between the housing and the stroke ring is connected to at least one connection disposed in at least one of the side plates, the housing side walls, or the stroke ring to that region within the pump which extends from the start of the separation region of the pump, i.e. from the end of the suction region, to the end of the damping notch, i.e. to the start of the pressure region or of the pressure kidney, in the peripheral direction within the rotation assembly, i.e. in the separation region of the pump between the suction region and the pressure region and/or the damping notch.

11. The pump as claimed in claim 10 wherein the connection of the separation region to the second pressure-action surface is disposed within the separation region in one of the side plates or housing side walls.

12. The pump as claimed in claim 10 wherein the connection of the separation region to the second pressure-action surface is disposed in the adjustable stroke ring.

13. The pump as claimed in claim 10 wherein the second pressure-action surface of the compensation chamber is equipped with a second connection into the pressure region of the pump, for instance into the pressure kidney.

14. The pump as claimed in claim 10 wherein the control device or the regulating/control valve is disposed in a third connection between the pressure region of the pump and the first pressure-action surface of the control chamber.

15. The pump as claimed in claim 14 wherein the control device or the regulating/control valve is adjusted by one or more electromagnets and/or by an external control pressure and/or by an internal control pressure and/or by an electric motor.

16. The pump as claimed in claim 10 wherein the second pressure-action surface of the compensation chamber upon the stroke ring and the first pressure-action surface of the control chamber upon the stroke ring form jointly with the stroke ring, with the pump housing, and with the side plates and with sealing devices forming demarcations for the pressure chambers, the compensation chamber and the control chamber.

17. The pump as claimed in claim 10 wherein the compensation chamber and/or the control chamber are alternatively formed by two adjusting cylinders which act generally in opposite directions on the stroke ring.

18. The pump as claimed in claim 10 wherein the stroke ring is arranged pivotably about a bearing bolt or is arranged radially displaceably in a guide.

19. The pump as claimed in claim 10 wherein hydraulic resistors, for instance damping orifices, are arranged in the connections from the compensation chamber to the separation region and/or to the pressure region and in the connection from the control chamber via the valve connection to the pressure region.

* * * * *